US010660439B2

(12) United States Patent
McKenzie et al.

(10) Patent No.: US 10,660,439 B2
(45) **Date of Patent: *May 26, 2020**

(54) BRACKET MECHANISM FOR PRE-FABRICATED OFFICE ENCLOSURE BEAMS AND METHOD OF USING THE SAME

(71) Applicant: Knoll, Inc., East Greenville, PA (US)

(72) Inventors: James Harrison McKenzie, Perkasie, PA (US); James Eldon, Pennsburg, PA (US); David McClanahan, Pennsburg, PA (US); Christopher Bender, Hatfield, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/522,880

(22) Filed: Jul. 26, 2019

(65) Prior Publication Data

US 2019/0343281 A1 Nov. 14, 2019

Related U.S. Application Data

(63) Continuation of application No. 15/979,921, filed on May 15, 2018, now Pat. No. 10,405,657.
(Continued)

(51) Int. Cl.

| | |
|---|---|
| ***A47B 96/06*** | (2006.01) |
| ***A47B 83/00*** | (2006.01) |
| ***E04B 2/78*** | (2006.01) |
| ***A47B 21/06*** | (2006.01) |
| ***E04B 2/74*** | (2006.01) |

(Continued)

(52) U.S. Cl.
CPC ..... *A47B 96/067* (2013.01); *A47B 21/06* (2013.01); *A47B 83/001* (2013.01); *E04B 2/7818* (2013.01); *E04B 2/7433* (2013.01); *E04B 9/10* (2013.01); *E04B 2001/2457* (2013.01)

(58) Field of Classification Search
CPC ..... A47B 96/067; A47B 21/06; A47B 83/001; A47B 96/06; A47B 96/063; A47B 96/066; A47B 96/068; A47B 96/07; A47B 96/145; A47B 96/1441; A47B 96/1458; A47B 96/205; A47B 2230/0018; A47B 2230/0022; A47B 2230/0044; A47B 2230/0062; A47B 2230/0066; A47B 2230/007; A47B 2230/16; E04B 2/7433; E04B 2/7818; E04B 2001/2457; E04B 9/10; Y10T 403/55; Y10T 403/557; Y10T 403/559; Y10T 403/43; Y10T 403/4381
USPC ..... 211/86.01, 191, 192, 162, 94.01, 151; 403/292, 297, 298, 206, 215; 248/220.21,
(Continued)

(56) References Cited

U.S. PATENT DOCUMENTS 3,299,840 A 1/1967 Richard
3,856,981 A 12/1974 Boundy
(Continued)

*Primary Examiner* — Jennifer E. Novosad
(74) *Attorney, Agent, or Firm* — Buchanan Ingersoll & Rooney PC

(57) ABSTRACT

A bracket mechanism is configured to facilitate connection of multiple rail elements to form an elongated element to span over a work space and/or to help support a continuous integral element spanning over a work space. The bracket mechanism can be configured to help ensure the rigidity of the elongated element positioned over the work space so that the elongated element does not sag or bow downwards as it extends over the work space.

24 Claims, 7 Drawing Sheets

Related U.S. Application Data

(60) Provisional application No. 62/507,311, filed on May 17, 2017.

(51) Int. Cl.
*E04B 9/10* (2006.01)
*E04B 1/24* (2006.01)

(58) Field of Classification Search
USPC ..... 248/220.22, 223.31, 222.51; 52/223.9, 52/223.11, 848, 849
See application file for complete search history.

(56) References Cited

U.S. PATENT DOCUMENTS 3,918,591 A * 11/1975 Cooper ..... A47F 5/108 211/204
4,081,100 A 3/1978 Presby
4,160,871 A * 7/1979 Lacroix ..... H01R 4/50 174/84 R
4,250,676 A 2/1981 Presby
4,257,203 A 3/1981 Propst et al.
4,325,597 A 4/1982 Morrison
4,406,101 A 9/1983 Heidmann
4,581,869 A 4/1986 Reuter
4,593,505 A 6/1986 Russell
4,616,951 A * 10/1986 Maatela ..... E04B 1/615 403/290
4,619,486 A 10/1986 Hannah et al.
4,856,242 A 8/1989 Baloga et al.
4,876,835 A 10/1989 Kelley et al.
4,881,349 A 11/1989 Brown et al.
4,883,330 A 11/1989 Armstrong et al.
4,907,384 A 3/1990 Underwood
4,932,181 A 6/1990 Baxter et al.
4,949,518 A 8/1990 Nagel et al.
4,996,811 A 3/1991 Dull et al.
5,065,556 A 11/1991 Delong et al.
5,088,250 A 2/1992 Delong et al.
5,088,541 A 2/1992 Persing et al.
5,138,759 A * 8/1992 Gruetzmacher ..... B23Q 9/0042 269/47
5,214,889 A 6/1993 Nienhuis et al.
5,511,348 A 4/1996 Cornell et al.
5,685,113 A 11/1997 Reuter et al.
5,768,840 A 6/1998 Feldpausch et al.
5,806,967 A 9/1998 Soorus et al.
5,809,907 A * 9/1998 Bumgarner ..... B65D 19/0071 108/51.11
5,816,001 A 10/1998 Goodman et al.
5,860,253 A * 1/1999 Lapointe ..... G09F 7/18 248/548
5,890,325 A 4/1999 Corcorran et al.
5,901,512 A 5/1999 Bullwinkle
5,918,433 A 7/1999 Reuter et al.
5,921,040 A 7/1999 Glashouwer et al.
6,021,613 A 2/2000 Reuter et al.
6,029,587 A 2/2000 Rozier et al.
6,068,041 A 5/2000 Miles et al.
6,073,399 A 6/2000 Shipman et al.
6,098,358 A 8/2000 Waalkes et al.
6,112,472 A 9/2000 Van et al.
6,115,977 A 9/2000 Hornberger et al.
6,209,273 B1 4/2001 Jeffers et al.
6,216,398 B1 4/2001 Shipman et al.
6,230,445 B1 5/2001 Arko et al.
6,250,019 B1 6/2001 Simons et al.
6,250,020 B1 6/2001 Shipman
6,317,981 B1 * 11/2001 Clive-Smith ..... B65D 19/385 29/897.35
6,330,773 B1 12/2001 MacDonald et al.
6,367,213 B1 4/2002 Reuter et al.
6,389,988 B1 5/2002 Frattini
6,434,893 B1 * 8/2002 Quenzi ..... E04G 11/48 52/126.1
6,481,169 B1 11/2002 Ludwig et al.
6,497,075 B1 12/2002 Schreiner et al.
6,546,684 B2 4/2003 Waalkes et al.
6,681,532 B1 1/2004 Palmbos et al.
6,711,871 B2 3/2004 Beirise et al.
6,748,710 B2 6/2004 Gresham et al.
6,751,914 B2 6/2004 Zeh et al.
6,994,222 B2 * 2/2006 Hunt ..... A47B 81/068 211/183
7,007,815 B2 * 3/2006 Anderson ..... A47F 5/01 211/183
7,025,217 B2 * 4/2006 Crown ..... A47B 96/07 211/175
7,028,854 B1 * 4/2006 Londrico ..... A47L 13/512 211/89.01
7,093,726 B1 * 8/2006 Holztrager ..... A47F 5/0043 211/153
7,134,561 B2 * 11/2006 Schneider ..... A47G 25/1457 211/118
7,150,127 B2 12/2006 Underwood et al.
7,310,918 B1 12/2007 Reuter et al.
7,387,212 B2 * 6/2008 Costa ..... A47B 47/022 211/90.01
7,448,502 B2 * 11/2008 Hunt ..... G11B 33/0461 211/40
7,469,793 B2 * 12/2008 Chen ..... A47B 53/02 211/162
8,152,001 B1 * 4/2012 Vinklarek ..... A47L 15/505 211/180
8,176,695 B2 5/2012 Deweerd et al.
8,205,760 B2 * 6/2012 Chang ..... A47H 1/102 211/105.3
8,276,769 B2 * 10/2012 Hogeback ..... A47F 7/28 211/74
8,579,121 B2 * 11/2013 Eng ..... A47L 15/505 211/184
8,646,622 B2 * 2/2014 Wollert ..... F16M 11/041 211/105.6
8,657,130 B2 * 2/2014 Thrush ..... A47F 5/08 211/117
8,998,008 B1 * 4/2015 Robertson ..... A47B 96/022 108/42
9,609,945 B2 4/2017 Krusin et al.
9,681,763 B2 6/2017 Udagawa et al.
9,730,513 B2 8/2017 Udagawa et al.
10,051,985 B2 * 8/2018 Jones ..... A47H 1/142
10,405,657 B2 * 9/2019 McKenzie ..... A47B 96/067
2003/0111941 A1 6/2003 Noel et al.
2004/0020137 A1 2/2004 Battey et al.
2006/0032186 A1 2/2006 Vardaro
2007/0206989 A1 * 9/2007 Wagner ..... E04F 11/1836 403/297
2009/0096277 A1 * 4/2009 Mercat ..... B60B 5/02 301/100
2010/0111598 A1 * 5/2010 Baur ..... E05B 63/123 403/348
2011/0298339 A1 12/2011 Udagawa et al.
2012/0167500 A1 7/2012 Henriott
2015/0351530 A1 12/2015 Udagawa et al.
2017/0226749 A1 8/2017 Fjetland
2019/0343281 A1 * 11/2019 McKenzie ..... E04B 2/7818

* cited by examiner

BRACKET MECHANISM FOR PRE-FABRICATED OFFICE ENCLOSURE BEAMS AND METHOD OF USING THE SAME

CROSS-REFERENCE TO RELATED APPLICATIONS

The present application is a continuation application of Ser. No. 15/979,921, which claims priority to U.S. Provisional Patent Application No. 62/507,311, filed on May 17, 2017.

FIELD OF INVENTION

The innovation relates to bracket mechanisms that can be used in connection with forming structures that may be utilized in connection with a work space such as, for example, a workspace defined by partitions, pre-fabricated office enclosures, and cubicle arrangements. The innovation also relates to methods of using such bracket mechanisms.

BACKGROUND OF THE INVENTION

Enclosures for office space often utilize walls and structure defined in or attached to a wall. Other enclosures may be free standing within a room of a building defined by internal and external walls of the building. The enclosures may include structures that are used to support a ceiling of the enclosure or support structures that may be mounted to a wall of the enclosure such as a chalkboard, whiteboard, display device or picture frame. Such structures occasionally support elements that can be suspended over the work space defined within the enclosure. Such elements can sag as they span over a work space and/or due to the weight of objects attached to such elements. For instance, a long beam structure that extends over a work surface can sag as it extends above a work space from one side of the work space to another side of the work space. This can create an undesired aesthetic effect for the work space, create the appearance of a safety issue due to this sagging, and can make attachment of other structures in a desired orientation to the long beam structure problematic (ensuring a level alignment, etc.).

SUMMARY OF THE INVENTION

A new bracket mechanism, a kit that provides the bracket mechanism, and method of using the bracket mechanism and/or kit are provided herein. In some embodiments, the bracket mechanism, kit, and/or method can help ensure that a suspended beam element is able to help keep beam members more rigid as they span over a workspace so that the beam members do not sink or bow downwards.

Embodiments of a method of using a bracket mechanism can include providing a first reinforcing member that is resiliently moveable from a curved orientation at which the first reinforcing member is curved along a length of the first reinforcing member to a linear orientation at which the first reinforcing member extends linearly and is no longer curved. The method can also include positioning the first reinforcing member in at least one of (i) a first opening of a first beam member and (ii) a first opening of a second beam member while the first reinforcing member is in the curved orientation and fastening the first reinforcing member to at least one of the first beam member and the second beam member so that the first reinforcing member is maintained in the linear orientation while also being fastened to at least one of the first beam member and the second beam member.

In some embodiments, the first reinforcing member can be positioned in the first opening of the first beam member and the first opening of the second beam member. In other embodiments, there may only be a single first beam member and the first reinforcing member can be positioned in a middle portion (e.g. a central section) of the first beam member. For such embodiments, the first reinforcing member can have a length that is about 40%-60% of the length of the first beam member (e.g. the first reinforcing member may be 2.45 meters long when the first beam member is 4.9 meters long, etc.).

The method can also include other steps. For instance, the method can include abutting a first end of the first beam member to a first end of the second beam member. The positioning of the first reinforcing member in the first opening of the first beam member and the first opening of the second beam member can occur while the first end of the first beam member abuts the first end of the second beam member.

As another example, the method can also include positioning clamping devices to engage the first reinforcing member when the first reinforcing member is positioned in the first opening of the first beam member and the first opening of the second beam member and moving the first reinforcing member from the curved orientation into the linear orientation via the clamping devices prior to the fastening of the first reinforcing member to the first beam member and the second beam member. When the clamping devices engage the first reinforcing member, a portion of each clamping device can contact the first reinforcing member and move to drive movement of the first reinforcing member toward its linear orientation. Another portion of each clamping device can engage the first beam member or the second beam member. The first reinforcing member can be positioned so that the first reinforcing member extends from adjacent the first end of the first beam member to adjacent to the second end of the second beam member when the first reinforcing member is moved into the linear orientation via the clamping devices.

An elongated element can be formed via the fastening of the first reinforcing member to the first beam member and the second beam member. Embodiments of the method can include steps that involve such an elongated element. For instance, embodiments of the method can include attaching the elongated element to different wall elements that are spaced apart from each other and at least partially define a workspace so that a portion of the elongated element is positioned above the workspace.

Embodiments of the method can also include use of bracket rails or other elements in addition to use of at least a first reinforcing member. For instance, embodiments of the method can include positioning a first bracket rail in the first beam member and the second beam member such that a first end of the first bracket rail is positioned in a first bracket rail opening of the first beam member and a second end of the first bracket rail is positioned in a second bracket rail opening of the second beam member. Embodiments of the method can also include positioning a second bracket rail in the first beam member and the second beam member such that a first end of the second bracket rail is positioned in a second bracket rail opening of the first beam member and a second end of the second bracket rail is positioned in a second bracket rail opening of the second beam member. The first bracket rail opening of the first beam member can be spaced apart from the second bracket rail opening of the first beam member and the first opening of the first beam member can be positioned between the first bracket rail opening of the first beam member and the second bracket rail opening of the first beam member. The first bracket rail opening of the second beam member can also be spaced apart from the second bracket rail opening of the second beam member and the first opening of the second beam member can be positioned between the first bracket rail opening of the second beam member and the second bracket rail opening of the second beam member. Such positioning of these openings can result in the first reinforcing member being in a central region of the first and second beam members and the first and second bracket rails being positioned along and/or adjacent respective sides (e.g. left and right sides) of the first reinforcing member. Such positioning of these openings can also result in the first bracket rail being positioned along and/or adjacent a side of the first and second beam members (e.g. left side or right side, front side or rear side, etc.) and the second bracket rail member being positioned along and/or adjacent the opposite side of the first and second beam members (e.g. left side if first bracket rail member is adjacent the right side, front side of the first bracket rail member is adjacent the rear side, etc.).

In some embodiments, the first bracket rail can extend from adjacent the first end of the first beam remember to adjacent the first end of the second beam member and the second bracket rail can extends from adjacent the first end of the first beam remember to adjacent the first end of the second beam member. Such positioning of the first and second bracket rails can allow for a middle portion of each bracket rail to extend over a joint defined at a location at which the first beam member contacts the second beam member when the first end of the first beam member abuts the first end of the second beam member.

In some embodiments, there may be more than one reinforcing member. For instance, the first reinforcing member can be a first bracket rail and the method can also include providing a second reinforcing member that is resiliently moveable from a curved orientation at which the second reinforcing member is curved along a length of the second reinforcing member to a linear orientation, positioning the second reinforcing member in a second opening of the first beam member and a second opening of a second beam member, and fastening the second reinforcing member to the first beam member and the second beam member so that the second reinforcing member is maintained in the linear orientation while also being fastened to the first beam member and the second beam member. In such embodiments, the second reinforcing member can be a second bracket rail. The first bracket rail can be spaced apart from the second bracket rail via a third opening of the first beam member and a third opening of the second beam member. These third openings may be centrally positioned in the first and second beams.

The first bracket rail can be positioned so that the first bracket rail extends from adjacent the first end of the first beam member to adjacent to the second end of the second beam member when the first bracket rail is moved into the linear orientation and the second bracket rail can be positioned so that the second bracket rail extends from adjacent the first end of the first beam member to adjacent to the second end of the second beam member when the second bracket rail is moved into the linear orientation. For such embodiments, the first and second bracket rails can be positioned so an intermediate section of each bracket rail extends over a joint defined at a location at which the first end of the first beam member contacts the first end of the second beam member when these beam members abut each other.

In some embodiments, the third opening of the first beam member can be at least partially defined by a sidewall of the first beam member that defines the first opening of the first beam member and a sidewall of the first beam member that defines the second opening of the first beam member. The third opening of the second beam member can be at least partially defined by a sidewall of the second beam member that defines the first opening of the second beam member and a sidewall of the second beam member that defines the second opening of the second beam member.

In some embodiments of the method, the first reinforcing member can be positioned in the first opening of the first beam member at a middle portion of the first beam member and the first reinforcing member can be fastened to the first beam member so that the first reinforcing member is maintained in a linear orientation while also being fastened to the first beam member while the first reinforcing member extends along a central section of the first beam member. The length of first reinforcing member when the first reinforcing member is moved into the linear orientation can be 40%-60% of a length of the first beam member. A first end of the first reinforcing member can be spaced apart from a first end of the first beam member and a second end of the first reinforcing member can be spaced apart from a second end of the first beam member.

An elongated element can be formed via the fastening of the first reinforcing member to the first beam member. Embodiments of the method can utilize such a formed elongated element. For instance, embodiments of the method can include attaching the elongated element to different wall elements that are spaced apart from each other and at least partially define a workspace so that a portion of the elongated element that includes the entirety of the first reinforcing member that is maintained in the linear orientation is positioned above the workspace. As another example, embodiments of the method can include attaching a first end of the first beam member to a first wall element and attaching a second end of the second beam member to a second wall element such that the first beam member extends between the first and second wall elements over a work space. The attaching of the first beam member can be performed before or after the first reinforcing member is fastened to the middle portion of the first beam member.

A kit for improving rigidity of an elongated element formed when a first beam member is attached to a second beam member is also provided. Embodiments of the kit can be configured to allow an elongated element to extend as it spans over a workspace so that it does not sink or bow downwards. Such a kit can include a first reinforcing member that is resiliently moveable between a curved orientation and a linear orientation, the first reinforcing member sized and configured to be positioned in (i) a first opening of the first beam member and (ii) a first opening of the second beam member. Embodiments of such a kit can also include a first bracket rail positionable in the first beam member and the second beam member such that a first end of the first bracket rail is positionable in a first bracket rail opening of the first beam member and a second end of the first bracket rail is positionable in a second bracket rail opening of the second beam member. Embodiments of such a kit can also include a second bracket rail positionable in the first beam member and the second beam member such that a first end of the second bracket rail is positionable in a second bracket rail opening of the first beam member and a second end of the second bracket rail is positionable in a second bracket rail opening of the second beam member. Embodiments of the kit can also include other elements, such as written instructions, fasteners, or mechanical tools.

In some embodiments of the kit, there may be a single first beam member that is positionable with an elongated larger beam element (e.g. an elongated element that is longer than the first beam member) that may be positionable for extending a number of meters from a first wall to a second wall over a work space (e.g. 2-5 meters, etc.). The single first beam member can be configured to be bowed, or arced over its length. The single first beam member can be positionable in a middle section of the elongated larger beam element via an upper opening in that elongated larger beam element so that the bowed or arced orientation of the single first beam member is changed to a linear orientation so that the single first beam member extends linearly when attached to the elongated larger beam element. Such an attachment of the single first beam member can help improve the rigidity of the elongated larger beam element so that this element does not sag or bow downwards when it is positioned to extend over a work space about a substantial part of its length (e.g. extends 2-5 meters between opposed walls, opposed partition walls etc.).

A bracket mechanism is also provided. Embodiments of the bracket mechanism can include one or more elements of the kit.

It should be appreciated that the linear orientation of a reinforcing member and the curved orientation for a reinforcing member can have different characteristics. A curved orientation can include the reinforcing member extending along a length (e.g. the largest dimension of the member as the member extends from a first end to an opposite second end) along a curve. Such an orientation can result in the reinforcing member appearing to be bowed or have an arc-like shape. The linear orientation can be an orientation in which the reinforcing member extends straight along its length (e.g. there is no curvature as the reinforcing member extends straightly from its first end to its second end along its length).

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of a bracket mechanism and kit are shown in the accompanying drawings and certain exemplary methods of making and practicing the same are also illustrated therein. It should be appreciated that like reference numbers used in the drawings may identify like components.

DETAILED DESCRIPTION OF EXEMPLARY EMBODIMENTS

Figure 1:
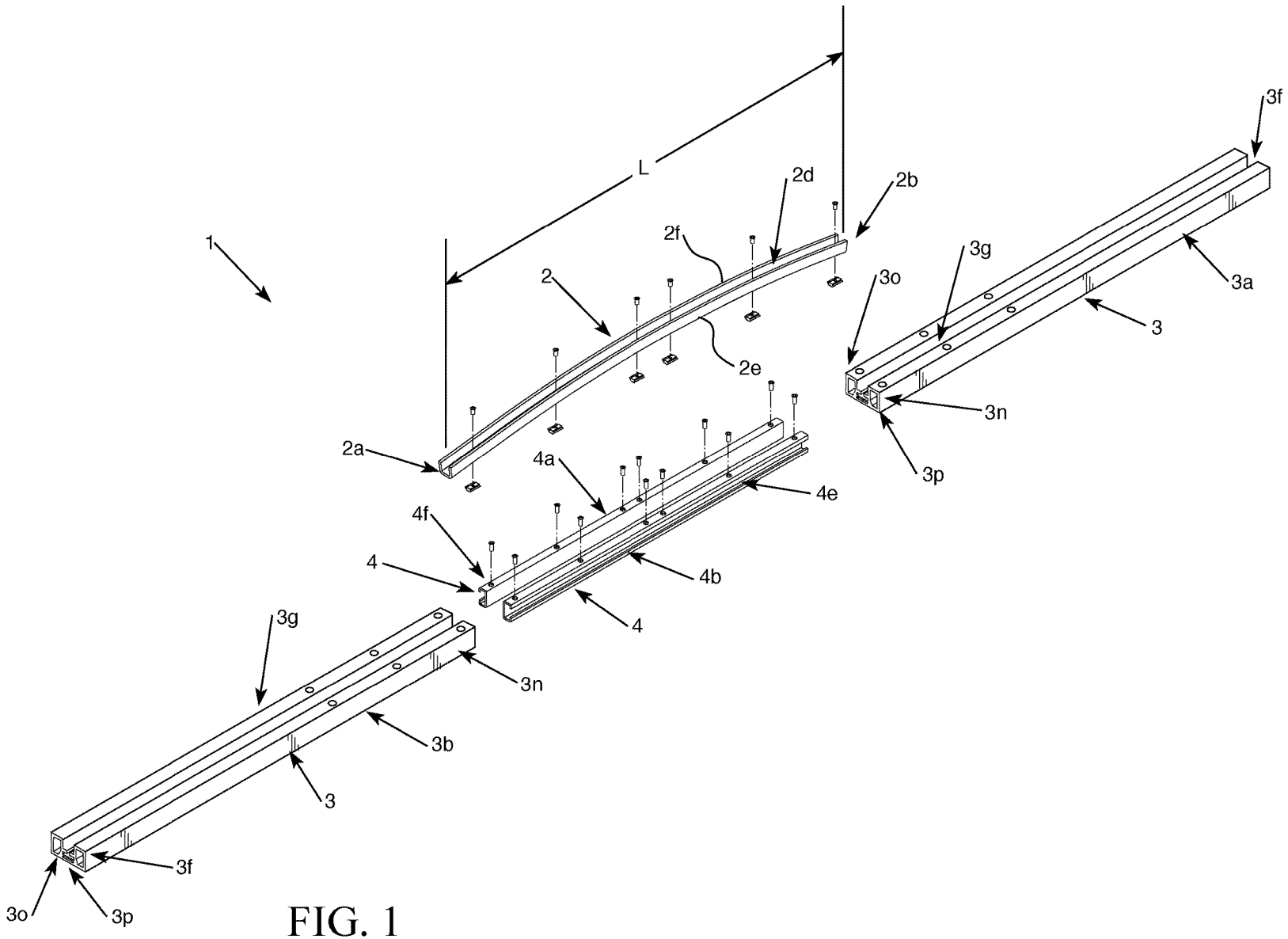
FIG. 1 is a perspective view of a first exemplary bracket mechanism 1 for attachment of two different beam members 3 together to from an elongated element 15 that can be positioned to span over a work surface between two different free standing wall-like elements (e.g. walls, wall-elements of a partition or cubicle, etc.).
Figure 2:
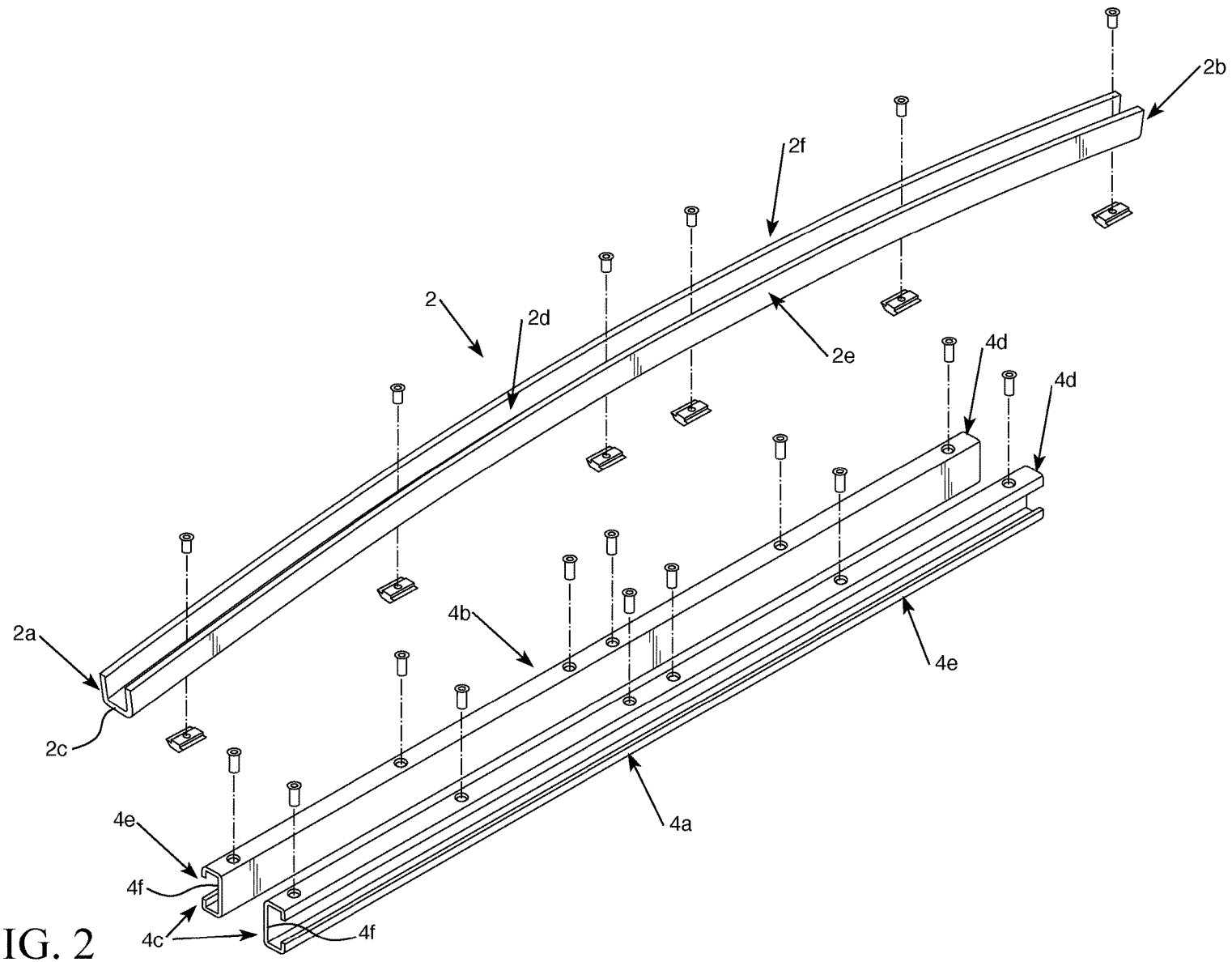
FIG. 2 is enlarged exploded view of the first exemplary embodiment of the bracket mechanism 1 shown in FIG. 1.
Figure 3:
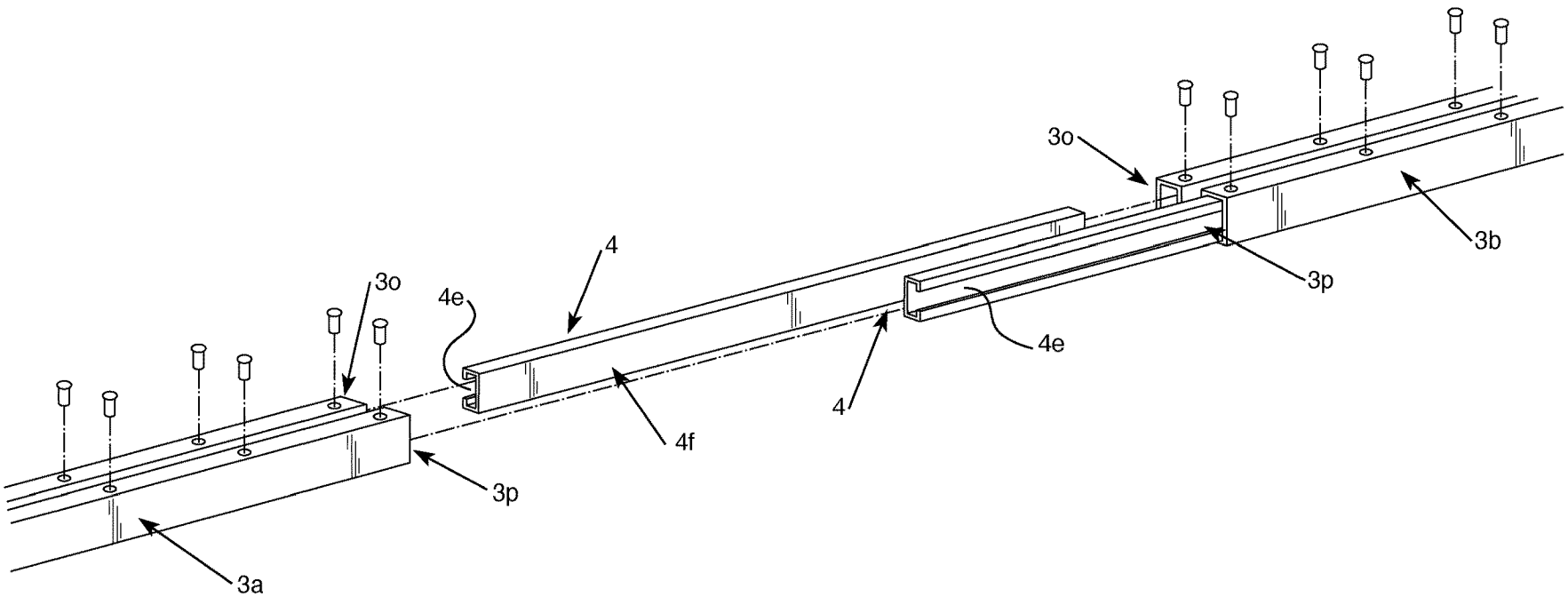
FIG. 3 is a fragmentary perspective view illustrating an exemplary way in which components of the first exemplary embodiment of the bracket mechanism 1 may be positioned for facilitating formation of the elongated element 15.

Referring to FIGS. 1-10 a bracket mechanism 1 can include a reinforcing member 2 that is positionable between two elongated rail members 4 for attaching opposite ends of beam members 3 together to form an elongated element 15 that may span over a workspace between two walls or wall-like structures (e.g. columns, walls, posts, frames, etc.). The reinforcing member 2 can be resiliently moveable from a curved orientation to a linear orientation. In the curved orientation, the reinforcing member can be curved along its length L. In the linear orientation, the reinforcing member can be moved out of its curved orientation so that the reinforcing member extends linearly from its first end to its opposite second end.

The formed elongated element 15 may be configured as a portion of a long beam-like structure or may be such a beam-like structure that extends from one side of a workspace to an opposite side of the workspace. The elongated element 15 can be configured to be positioned over a work surface so that a substantial portion of its length extends over a floor or other work surface of a work space. The entirety of the reinforcing member can be positioned over the work space via its position in the elongated element.

The beam members 3 can include a first beam member **3*a* and a second beam member 3*b*. Each beam member can have a first end 3*n* and a second opposite end 3*f*. An upper opening 3*g* can be defined in the beam member and extend from the first end 3*n* to the second end 3*f*. Each beam member 3 can also define bracket rail receiving openings that may extend along a length of the beam member. For instance, each beam member 3 can be structured to define or form a first bracket rail opening 3*o* and a second bracket rail opening 3*p*. Each bracket rail opening can be sized and configured to receive a bracket rail 4 therein or a portion of a bracket rail 4 therein. In each beam member 3, a sidewall that helps define the first bracket rail opening 3***o* can also define the upper opening 3*g* and a sidewall that helps define the second bracket rail openings 3*p* can also define the upper opening 3*g* (e.g. these sidewalls that extend above the bottom of the beam member 3 can define sides of the upper opening 3*g* above the bottom of the beam member 3).

For example, a first bracket rail 4*a* can be configured for being received within the first bracket rail openings 3*o* of first and second beam members 3*a* and 3*b* for facilitating the first and second beam members 3*a* and 3*b* being attached together so that the first end 3*n* of the first beam member 3*a* abuts the first end 3*n* of the second beam member 3*b*. A second bracket rail 4*b* can also be configured for being received within the second bracket rail openings 3*p* of first and second beam members 3*a* and 3*b* for facilitating the first and second beam members 3*a* and 3*b* being attached together so that the first end 3*n* of the first beam member 3*a* abuts the first end 3*n* of the second beam member 3*b*.

When positioned within the first and second beam members 3*a* and 3*b*, the first end 4*c* of the first bracket rail 4*a* can be positioned within the first bracket rail opening 3*o* of the first beam member 3*a* and the second end 4*d* of the first bracket rail 4*a* can be positioned within the first bracket rail opening 3*o* of the second beam member 3*b*. When positioned within the first and second beam members 3*a* and 3*b*, the first end 4*c* of the second bracket rail 4*b* can be positioned within the second bracket rail opening 3*p* of the first beam member 3*a* and the second end 4*d* of the second bracket rail 4*b* can be positioned within the second bracket rail opening 3*p* of the second beam member 3*b*.

Each bracket rail member 4 can define an elongated opening 4*e* that faces toward an external wall of the beam member 3 that defines the bracket rail opening in which that bracket rail member is positioned. A flat wall element 4*f* of the bracket rail member 4 that at least partially defines the elongated opening 4*e* can be positioned adjacent to the upper opening 3*g* formed in the beam member 3 adjacent the bracket rail opening in which the bracket rail member is positioned.

Figure 8:
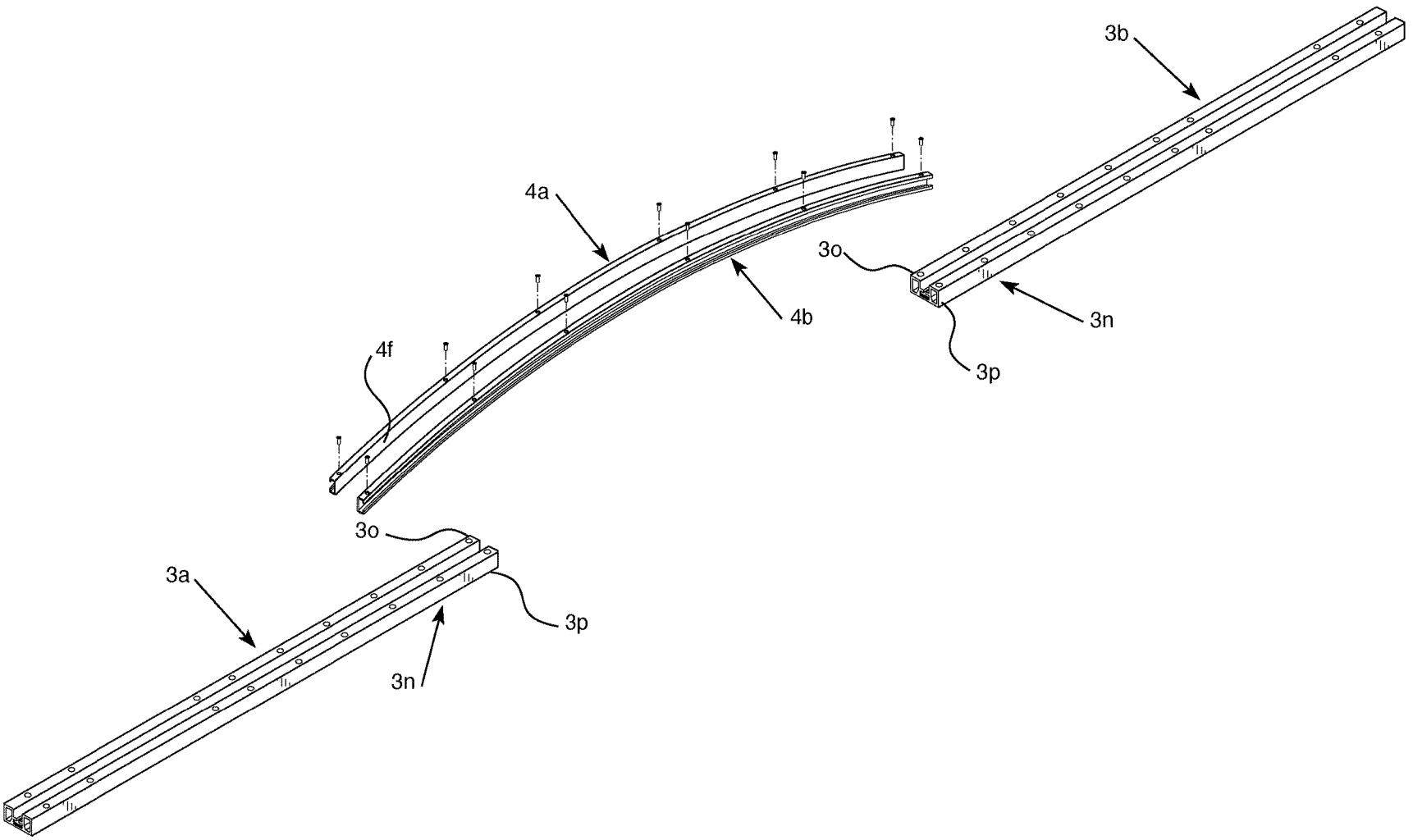
FIG. 8 is an exploded via of an exemplary bracket mechanism 1 for attachment of two different beam members 3 together to from an elongated element 15 that can be positioned to span over a work surface between two different free standing wall-like elements (e.g. walls, wall-elements of a partition or cubicle, etc.).
Figure 9:
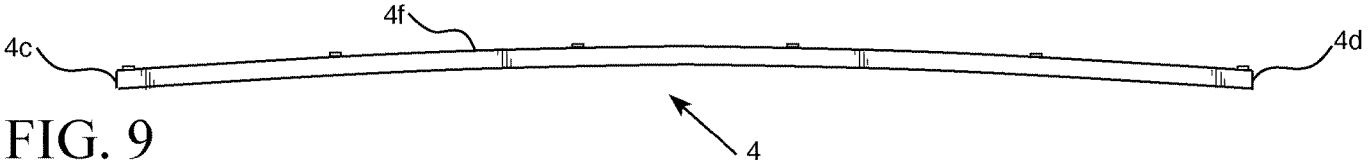
FIG. 9 is a side view of an exemplary bracket rail member 4 illustrated in FIG. 8.

In other embodiments, each bracket rail member 4 may not include the slit that defines the elongated opening 4*e* that has a mouth or slit therein. Instead, those bracket rail members may have an elongated channel that is fully enclosed by the outer peripheral structure of the bracket rail member to define an elongated channel of a tubular body that is circular, oval, polygonal, or rectangular in cross sectional profile. For such embodiments, the bracket rail member 4 may have one or more peripheral wall elements 4*f* that are integrally connected together to define the inner elongated channel within the bracket rail member 4. An example of such an alternative embodiment of the bracket rail members 4 is shown in FIG. 8.

The upper opening 3*g* of the first and second beam members 3*a* and 3*b* can be aligned when the first and second beam members' first ends 3*n* abut each other. The reinforcing member 2 can be positioned within the aligned upper openings 3*g* of the first and second beam members 3*a* and 3*b* as may be appreciated from FIGS. 4-6. The reinforcing member 2 can be attached to the beam members 3 to help bias the beam members to a more linearly extending orientation as they extend between walls or over a work space so that the reinforcing member's attachment to the beam members 3 helps the beam members 3 avoid sagging or bowing downwards when the beam members are attached together and positioned to linearly extend over a work space. The first end 2*a* of the reinforcing member 2 can be attached to the first beam member 3*a* adjacent to the first end 3*n* of the first beam member 3*a*. The second end 2*b* of the reinforcing member 2 that is opposite its first end 2*a* can be attached to the second beam member 3*b* adjacent to the first end 3*n* of the second beam member 3*b*.

Embodiments of the reinforcing member 2 can be structured to have an upper opening 2*d* defined by spaced apart first and second sidewalls 2*e* and 2*f* that extend from the first end 2*a* to the second end 2*b* of the body of the reinforcing member 2. The reinforcing member can also have a bottom 2*c* that extends from the first end 2*a* to the second end 2*b* of the body of the reinforcing member between the first and second sidewalls 2*e* and 2*f* The bottom 2*c* and the first and second sidewalls 2*e* and 2*f* may define the upper opening 2*d*. The upper opening 2*d* can define a top opening that is able to receive cabling or wiring (e.g. data wiring, power wiring, etc.) so that wiring can be positioned in the upper opening 2*d* and routed through the reinforcing member 2.

Figure 4:
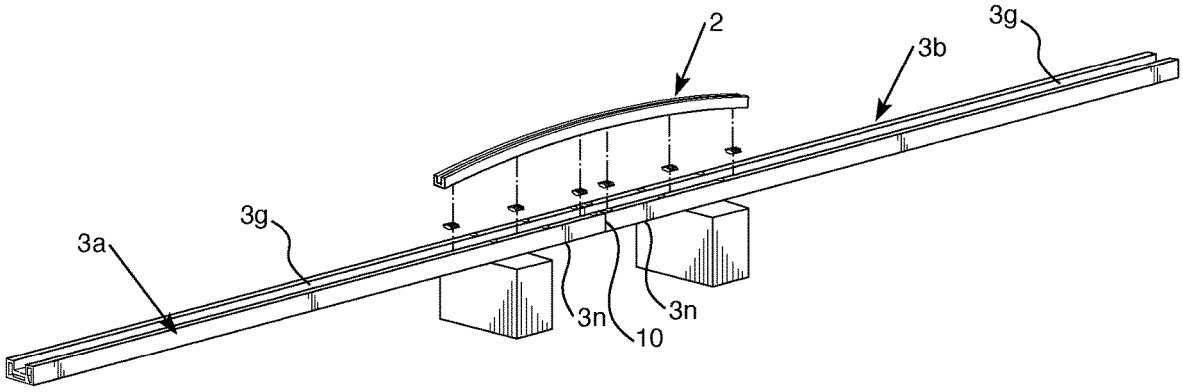
FIG. 4 is an exploded fragmentary perspective view illustrating an exemplary way in which a bracket element having a curved profile (e.g. a concave bend) of the first exemplary embodiment of the bracket mechanism 1 may be positioned for facilitating formation of the elongated element 15.
Figure 5:
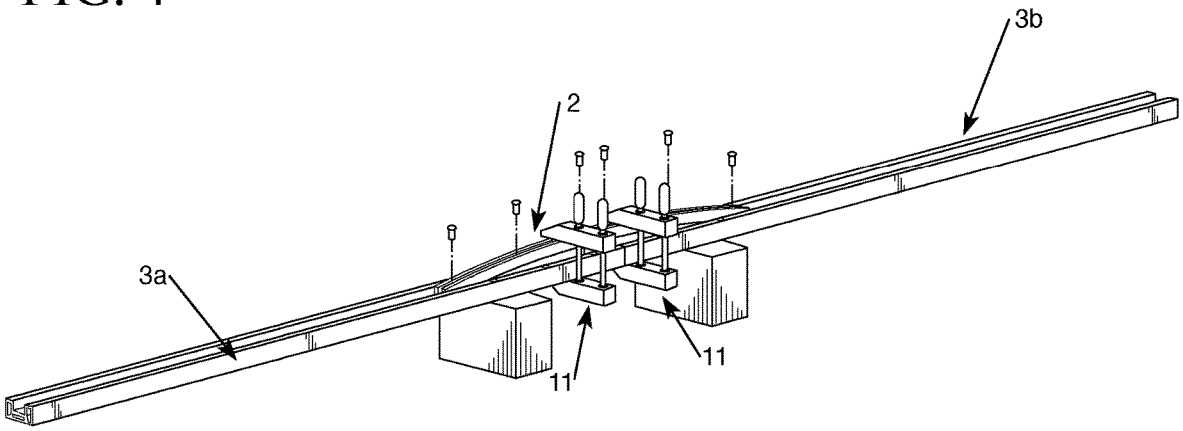
FIG. 5 is a fragmentary perspective view illustrating the exemplary way in which a bracket element having a curved profile (e.g. a concave bend) of the first exemplary embodiment of the bracket mechanism may be positioned for facilitating formation of the elongated element 15.
Figure 6:
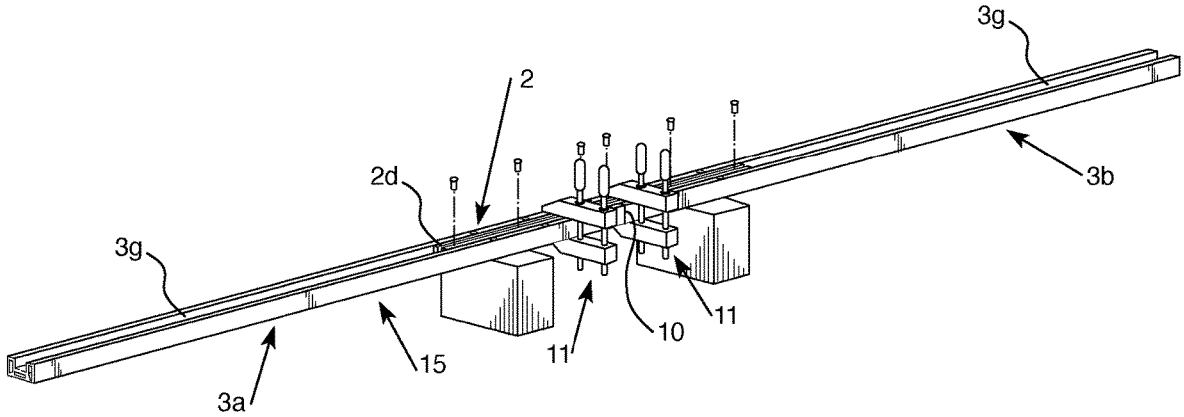
FIG. 6 is a fragmentary perspective view illustrating an exemplary way in which a bracket element having a curved profile (e.g. a concave bend) of the first exemplary embodiment of the bracket mechanism may be manipulated into a linear orientation for attachment to different beam members 3 for facilitating formation of the elongated element.

As can be appreciated from FIGS. 4-6, the curved beam 2 can be positioned within the upper openings 3*g* of the first and second beam members 3*a* and 3*b* so that the upper opening 2*d* of the reinforcing member 2 faces upwardly and the bottom 2*c* of the reinforcing member contacts the beam members 3*a* and 3*b*. In some embodiments, the first sidewall 2*e* may face towards the first bracket rail member 4*a* and the second sidewall 2*f* may face toward the second bracket rail member 4*b* when the reinforcing member is positioned within the upper openings 3*g* of the first and second beam members 3*a* and 3*b*.

Once the reinforcing member 2 is positioned in the first and second beam members 3*a* and 3*b* between the first and second bracket rail members 4*a* and 4*b* as shown in FIG. 5, the first end 2*a* of the reinforcing member 2 can be fastened to the first beam member 3*a* and the second end 2*b* of the reinforcing member 2 can be fastened to the second beam member 3*b* via fasteners (e.g. screws, bolts, etc.). The reinforcing member 2 may be so fastened such that the middle portion of the reinforcing member and middle portion of the bottom 2*c* is spaced apart from the beam members 3 and is at a more elevated position than the first and second ends 2*a* and 2*b* of the reinforcing member 2 fastened to the first and second beam members 3*a* and 3*b*. The reinforcing member can then be moved from its curved orientation to a more planar, flat, or linear orientation via clamping devices 11 (e.g. clamps, screw clamps or other type of clamp devices). The clamping devices 11 can be utilized to force the curved beam 2 to move from its curved orientation into a more planar, or flat position so that it extends from its first end 2*a* to its second end 2*b* linearly instead of along a curve. Once the reinforcing member 2 is moved from its curved orientation to a flat or linear orientation via the clamping devices 11, the reinforcing member 2 may be fastened to the first and second beam members 3*a* and 3*b* via fasteners at different locations between its first and second ends 2*a* and 2*b*. This fastening can be performed such that the middle portion of the reinforcing member is no longer elevated relative to its first and second ends 2*a* and 2*b*. The bottom 2*c* of the reinforcing member 2 may be in contact with the beam member 3 due to the fasteners being utilized to attach the middle portion of the reinforcing member 2 to the first and second beam members 3*a* and 3*b* after the clamping devices 11 were used to change the orientation of the reinforcing member 2 from the curved orientation to a linear orientation or at least a substantially more linear orientation as compared to the initial curved orientation of the reinforcing member.

Figure 7:
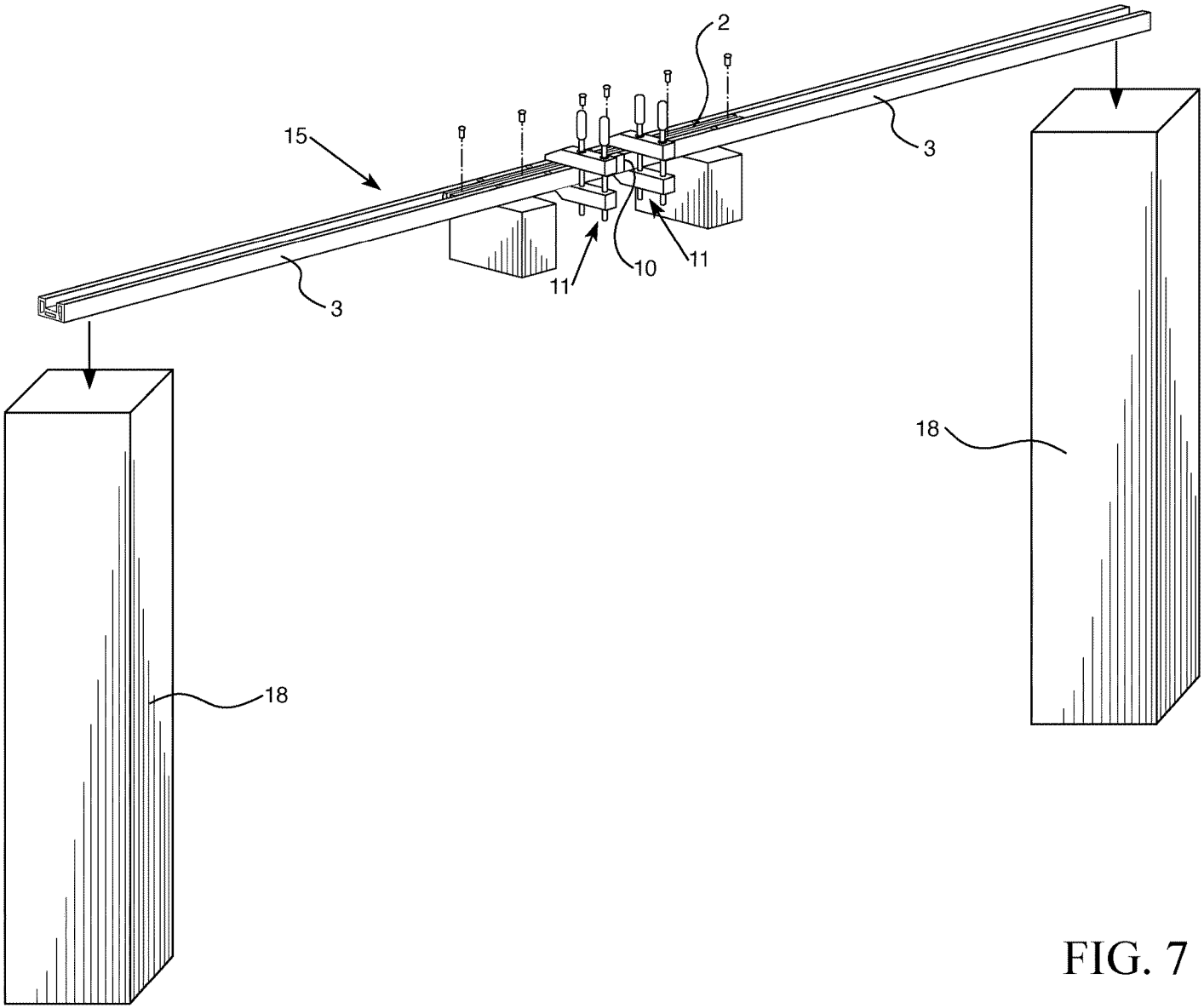
FIG. 7 is an exploded fragmentary view of an exemplary embodiment of a formed elongated element 15 being positioned for spanning over a workspace at least partially defined by wall-like elements 18.

Once the fasteners attach the reinforcing member 2 in its location, the clamping devices 11 may be removed. The elongated member 15 formed via the attachment of the first and second beam members may then be positioned to extend over a workspace as an overhead beam or may have its opposite ends attached to other beam members via use of other bracket mechanisms 1. For example, as shown in FIG. 7, the elongated element 15 can be positioned to extend between wall-like elements 18 (e.g. walls, wall-like structures of a partition system, cubicle walls or partitions, etc.) that may at least partially define a workspace (e.g. a room, a cubicle, etc.).

The reinforcing member 2 can be composed of a resilient metal or other material that can facilitate the adjustment in orientation from a curved orientation to a linear or substantially more linear orientation. The structure and resiliency of the reinforcing member 2 can help provide a biasing force at the junction 10, or joint, at which the first ends 3*n* of the first and second beam members 3*a* and 3*b* abut each other to help provide a force that helps keep the beam members 3 more rigid as they span over a workspace so that the beam members 3 do not sink or bow downwards. Use of the reinforcing member 2 can also help ensure the alignment and abutment of the first ends 3*n* of the beam members 3 are effectively maintained.

In other embodiments, the reinforcing member 2 may not be utilized. For such embodiments, it is contemplated that the bracket rail members 4 can be structured as reinforcing members that are resiliently moveable from an initial curved orientation at which the member is curved as it extends along its length to a linear orientation at which each member extends linearly from its first end to its second end. When the bracket rail members 4 have such a configuration, they can be considered reinforcing members (e.g. first bracket rail member 4*a* can be considered a first reinforcing member and second bracket rail 4*b* member can be considered a second reinforcing member, etc.). Such bracket rail members can provide the anti-sagging functionality provided by reinforcing member 2 while also helping to keep a middle channel of the beam members 3 open (e.g. third central openings of the first and second beam members, such as upper opening 3*g*, etc.) for routing and/or positioning of cables, wiring, or other elements. For such embodiments, the curvature of each of the bracket rail members may be removed upon the fastening of the bracket rail member to a beam member via fasteners such that the resiliency of the material of the bracket rail member provides a force to help prevent sagging of the beam members 3 to which it is fastened. Clamping devices or other type of device can also be used to help move the middle portion of such bracket rail members 4 into their linear orientation prior to fastening the members to the beam members to maintain those bracket rail members 4 in their linear orientation. It should be understood that the first and second bracket rail openings 3*o* and 3*p* can be sized to accommodate the curvature of the bracket rail members for receiving those members. Formed elongated element 15 shown in FIG. 7 would not include a reinforcing member 2 for such embodiments.

It should be appreciated that the linear orientation of a reinforcing member and the curved orientation of the reinforcing member can have different characteristics (for any type of member configured as a reinforcing member such as a bracket rail member 4 configured as a reinforcing member or a reinforcing member 2, etc.). A curved orientation can include the reinforcing member extending along a length (e.g. the largest dimension of the member as the member extends from a first end to an opposite second end) along a curve. Such an orientation can result in the reinforcing member appearing to be bowed or have an arc-like shape. The linear orientation can be an orientation in which the reinforcing member extends straight along its length (e.g. there is no curvature as the reinforcing member extends straightly from its first end to its second end along its length). In some embodiments, the degree of curvature may be relatively slight for the curved orientation. The linear orientation will also result in the reinforcing member's curvature as it extends along its length being eliminated or at least significantly and substantially eliminated (e.g. there may be very slight undulations due to manufacturing tolerance issues in a member, but the member will extend linearly along its length and be straight as it extends along its length from its first end to its opposite second end).

Figure 10:
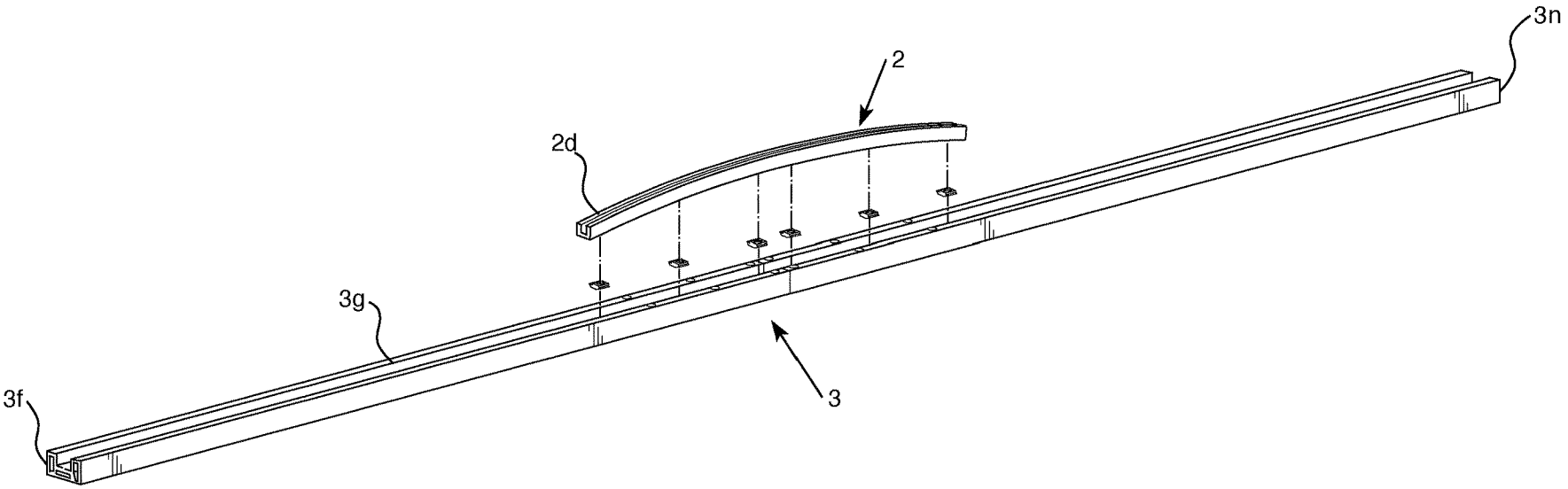
FIG. 10 is an exploded via of an exemplary bracket mechanism 1 for attachment to a beam member to help prevent the beam member from sagging as it extends between wall-like elements.

In yet other embodiments, a single integral beam member 3 may be configured as a continuous beam that linearly extends from its first end to its opposite second end between different wall-like elements 18 (e.g. walls, columns, etc.). A single reinforcing member 2 can be attached within a central open channel defined in that integral beam member to help prevent that beam member from sagging as shown in FIG. 10. Bracket rail members 4 may not be utilized in such embodiments. The reinforcing member 2 may be positioned in a center of the integral beam member or may be positioned within only a middle section of the beam member such that end sections of the beam member do not contact the reinforcing member 2. The opposite ends of the reinforcing member 2 can be attached to the middle section of the single beam member 3. Then one or more clamping devices can be used to help move the reinforcing member 2 into its linear orientation. The middle portion of the reinforcing member can then be fastened to the beam member 3. In some embodiments, it is contemplated that the clamping devices may not be used and the use of fasteners to fasten the middle portion of the reinforcing member (e.g. via a screw driver or wrench) can provide the force for moving the reinforcing member to its linear orientation so that, once fastened to the beam member 3, the reinforcing member 2 is maintained in its linear orientation.

In some embodiments, the reinforcing member 2 may be about half the length of the long integral beam member (which can be configured as a continuous beam member) to which it is fastened. For instance, the length of the reinforcing member 2 may be half the length of the integral beam member or may be 40-60% of the length of the integral beam member that extends from a first wall-like element to a second wall-like element (e.g. a wall, column, partition, etc.).

It should be understood that embodiments of the bracket mechanism and kit may be configured to meet different design criteria. For instance, the material composition, length, degree of curvature, and particular geometric structure of a reinforcing member, bracket rail, or beam member can be changed to meet a particular set of design criteria. As another example, the size, shape, or location of an elongated element over a work surface can be any of a number of suitable locations (e.g. suspended over a work space in an office or residential building, etc.). As yet another example, it is contemplated that a particular feature described, either individually or as part of an embodiment, can be combined with other individually described features, or parts of other embodiments. The elements and acts of the various embodiments described herein can therefore be combined to provide further embodiments. Therefore, while certain exemplary embodiments of bracket mechanisms and kit and methods of making and using the same have been discussed and illustrated herein, it is to be distinctly understood that the invention is not limited thereto but may be otherwise variously embodied and practiced within the scope of the following claims.

What is claimed is:

1. A method of using a bracket mechanism comprising:

providing a first reinforcing member that is resiliently moveable from a curved orientation at which the first reinforcing member is curved along a length of the first reinforcing member to a linear orientation at which the first reinforcing member extends linearly;

positioning the first reinforcing member in (i) a first opening of a first beam member, the first opening of the first beam member being an upper opening that faces upwardly and extends between a first end of the first beam member to a second end of the second beam member and (ii) a first opening of a second beam member, the first opening of the second beam member being an upper opening that faces upwardly and extends between a first end of the second beam member to a second end of the second beam member, the positioning of the first reinforcing member occurring while the first reinforcing member is in the curved orientation to place the first reinforcing member on a bottom of the first beam member that defines a bottom portion of the first opening and a bottom of the second beam member that defines a bottom portion of the second opening; and while the first reinforcing member is positioned in the first opening of the first beam member and the first opening of the second beam member, attaching the first reinforcing member to the first beam member and the second beam member so that the first reinforcing member is moved into the linear orientation while also being attached to the first beam member and the second beam.

2. The method of claim 1, wherein the first reinforcing member is positioned in the first opening of the first beam member between sidewalls of the first beam member that extend above the bottom of the first beam member and the first reinforcing member is positioned in the first opening of the second beam member between sidewalls of the second beam member that extend above the bottom of the second beam member.

3. The method of claim 1, wherein the first reinforcing member is positioned so that the first reinforcing member extends between the first beam member and the second beam member when the first reinforcing member is moved into the linear orientation.

4. The method of claim 1, wherein an elongated element is formed via the attaching of the first reinforcing member to the first beam member and the second beam member, the method also comprising:

attaching the elongated element to different wall elements that are spaced apart from each other and at least partially define a workspace so that a portion of the elongated element is positioned above the workspace.

5. The method of claim 1, comprising:

moving the first reinforcing member from the curved orientation into the linear orientation prior to the attaching of the first reinforcing member to the first beam member and the second beam member so that the first reinforcing member is maintained in the linear orientation while being attached to the first beam member and the second beam member.

6. The method of claim 1, comprising:

positioning a first bracket rail in the first beam member and the second beam member such that a first end of the first bracket rail is positioned in a first bracket rail opening of the first beam member and a second end of the first bracket rail is positioned in a first bracket rail opening of the second beam member.

7. The method of claim 6, comprising:

positioning a second bracket rail in the first beam member and the second beam member such that a first end of the second bracket rail is positioned in a second bracket rail opening of the first beam member and a second end of the second bracket rail is positioned in a second bracket rail opening of the second beam member.

8. The method of claim 7, wherein:

the first bracket rail opening of the first beam member is spaced apart from the second bracket rail opening of the first beam member and the first opening of the first beam member is positioned between the first bracket rail opening of the first beam member and the second bracket rail opening of the first beam member; and the first bracket rail opening of the second beam member is spaced apart from the second bracket rail opening of the second beam member and the first opening of the second beam member is positioned between the first bracket rail opening of the second beam member and the second bracket rail opening of the second beam member.

9. The method of claim 6, wherein the first bracket rail extends from adjacent the first end of the first beam member to adjacent the first end of the second beam member and the second bracket rail extends from adjacent the first end of the first beam remember to adjacent the first end of the second beam member.

10. The method of claim 1, comprises:

providing a second reinforcing member that is resiliently moveable from a curved orientation at which the second reinforcing member is curved along a length of the second reinforcing member to a linear orientation, positioning the second reinforcing member in a second opening of the first beam member and a second opening of a second beam member;

attaching the second reinforcing member to the first beam member and the second beam member so that the second reinforcing member is in the linear orientation while also being attached to the first beam member and the second beam member.

11. The method of claim 10, wherein the first reinforcing member is spaced apart from the second reinforcing member;

the reinforcing member being positioned so that the first reinforcing member extends from adjacent the first end of the first beam member to adjacent to the first end of the second beam member when the first reinforcing member is moved into the linear orientation; and the second reinforcing member being positioned so that the second reinforcing member extends from adjacent the first end of the first beam member to adjacent to the first end of the second beam member when the second reinforcing member is moved into the linear orientation.

12. The method of claim 10, comprising:

abutting the first end of the first beam member to the first end of the second beam member.

13. The method of claim 1 wherein the first reinforcing member is positioned in the first opening of the first beam member at a middle portion of the first beam member and the first reinforcing member is fastened to the first beam member so that the first reinforcing member is in the linear orientation while also being fastened to the first beam member while the first reinforcing member extends along a central section of the first beam member.

14. The method of claim 13, wherein the length of the first reinforcing member, when the first reinforcing member is moved into the linear orientation, is 40%-60% of a length of the first beam member; and wherein a first end of the first reinforcing member is spaced apart from the first end of the first beam member and a second end of the first reinforcing member is spaced apart from the ft second end of the first beam member.

15. The method of claim 13, wherein an elongated element is formed via the attaching of the first reinforcing member to the first beam member, the method also comprising:

attaching the elongated element to different wall elements that are spaced apart from each other and at least partially define a workspace so that a portion of the elongated element that includes an entirety of the first reinforcing member that is maintained in the linear orientation is positioned above the workspace.

16. The method of claim 13, comprising:

attaching the first end of the first beam member to a first wall element and attaching the second end of the first beam member to a second wall element such that the first beam member extends between the first and second wall elements over a work space.

17. The method of claim 16, wherein the attaching of the first beam member is performed after the first reinforcing member is fastened to the middle portion of the first beam member.

18. A method of using a bracket mechanism comprising:

providing a first reinforcing member that is resiliently moveable from a curved orientation at which the first reinforcing member is curved along a length of the first reinforcing member to a linear orientation at which the first reinforcing member extends linearly;

positioning the first reinforcing member in a first upper opening of a first beam member and a first upper opening of a second beam member while the first reinforcing member is in the curved orientation;

attaching the first reinforcing member to at least one of the first beam member and the second beam member so that the first reinforcing member is in the linear orientation while also being attached to at least one of the first beam member and the second beam member; and abutting a first end of the first beam member to a first end of the second beam member; and wherein the positioning of the first reinforcing member in the first upper opening of the first beam member and the first upper opening of the second beam member occurs while the first end of the first beam member abuts the first end of the second beam member.

19. The method of claim 18, comprising:

using clamping devices to engage the first reinforcing member when the first reinforcing member is positioned in the first upper opening of the first beam member and the first upper opening of the second beam member; and moving the first reinforcing member from the curved orientation into the linear orientation via the clamping devices such that the first reinforcing member is no longer curved when in the linear orientation prior to the attaching of the first reinforcing member to the first beam member and the second beam member.

20. An apparatus for improving rigidity of an elongated element formed when a first beam member is attached to a second beam member comprising:

a first reinforcing member that is resiliently moveable between a curved orientation and a linear orientation, the first reinforcing member sized and configured to be positioned in (i) a first upper opening of the first beam member that faces upwardly and/or (ii) a first upper opening of the second beam member that faces upwardly, the first reinforcing member being attachable to at least one of the first beam member and the second beam member to position the first reinforcing member in the linear orientation while the first reinforcing member is on a bottom portion of the first beam member within the first upper opening of the first beam member and/or is on a bottom portion of the first beam member within the first upper opening of the second beam member and is attached to the first beam member and/or the second beam member.

21. The apparatus of claim 20, comprising:

a first bracket rail positionable in the first beam member and the second beam member such that a first end of the first bracket rail is positionable in a first bracket rail opening of the first beam member and a second end of the first bracket rail is positionable in a first bracket rail opening of the second beam member; and a second bracket rail positionable in the first beam member and the second beam member such that a first end of the second bracket rail is positionable in a second bracket rail opening of the first beam member and a second end of the second bracket rail is positionable in a second bracket rail opening of the second beam member.

22. The apparatus of claim 20, comprising:

the first beam member and the second beam member, the first beam member being positionable so that a first end of the first beam member abuts a first end of the second beam member at a junction; and wherein the first reinforcing member is attachable to the first beam member and the second beam member to position the first reinforcing member in the linear orientation while the first reinforcing member extends between the first beam member and the second beam member to provide a biasing force at the junction.

23. The apparatus of claim 20, comprising:

the first beam member, the first reinforcing member is attachable to the first beam member at a middle portion of the first beam member within the first upper opening of the first beam member to position the first reinforcing member in the linear orientation while the first reinforcing member extends along a portion of a length of the first beam member in the first upper opening of the first beam member.

24. The apparatus of claim 23, wherein:

when the first reinforcing member is moved into the linear orientation, a length of the first reinforcing member is 40%-60% of the length of the first beam member; and wherein a first end of the first reinforcing member is spaced apart from a first end of the first beam member and a second end of the first reinforcing member is spaced apart from a second end of the first beam member.

* * * * *